US007566124B2

(12) United States Patent
Kan et al.

(10) Patent No.: US 7,566,124 B2
(45) Date of Patent: Jul. 28, 2009

(54) IMAGE FORMING APPARATUS

(75) Inventors: Shoichi Kan, Yokohama (JP); Tetsuya Saito, Yokohama (JP); Noboru Shimoyama, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 270 days.

(21) Appl. No.: 11/127,187

(22) Filed: May 12, 2005

(65) Prior Publication Data

US 2005/0264635 A1 Dec. 1, 2005

(30) Foreign Application Priority Data

May 14, 2004 (JP) ..... 2004-145072

(51) Int. Cl.
*B41J 2/01* (2006.01)

(52) U.S. Cl. ..... 347/104; 271/9.01; 271/9.09; 271/18; 358/498; 358/505; 399/75; 399/131; 399/167; 399/367; 399/374; 400/188; 400/624; 400/625

(58) Field of Classification Search ..... None
See application file for complete search history.

(56) References Cited

U.S. PATENT DOCUMENTS

| | | | | |
|---|---|---|---|---|
| 5,177,547 | A | 1/1993 | Kanemitsu et al. | |
| 5,781,823 | A * | 7/1998 | Isobe et al. | 399/2 |
| 5,807,003 | A * | 9/1998 | Kobayashi et al. | 400/625 |
| 6,685,294 | B2 | 2/2004 | Gaasch et al. | |
| 6,909,872 | B2 * | 6/2005 | Eskey | 399/401 |
| 6,966,714 | B2 * | 11/2005 | Harris et al. | 400/188 |
| 2005/0264634 | A1 * | 12/2005 | Kan et al. | 347/104 |

FOREIGN PATENT DOCUMENTS

| | | |
|---|---|---|
| EP | 0 478 300 | 4/1992 |
| EP | 1 191 413 | 3/2002 |
| JP | 61-118276 | 5/1986 |
| JP | 03-238253 | 10/1991 |
| JP | 3-288761 | 12/1991 |
| JP | 5-33157 | 4/1993 |
| JP | 09-058918 | 3/1997 |
| JP | 10-083081 | 3/1998 |
| JP | 2002-321414 | 11/2002 |
| JP | 2003-40505 | 2/2003 |
| JP | 2003-334976 | 11/2003 |
| KR | 10-198772 | 3/1999 |

* cited by examiner

*Primary Examiner*—Matthew Luu
*Assistant Examiner*—John P Zimmermann
(74) *Attorney, Agent, or Firm*—Fitzpatrick, Cella, Harper & Scinto

(57) ABSTRACT

An ink jet recording apparatus includes a sheet feeding tray, a sheet discharge tray, an image recording portion including an ink jet recording head and a platen, a first roller portion, disposed between the sheet feeding tray and the image recording portion, and a second roller portion, disposed at a position across the image recording portion from the first roller portion, for feeding the recording material, and a guide, positioned between the sheet feeding roller and the first roller portion, for separating the recording material fed from the sheet feeding tray and that to be fed to the sheet discharge tray. After the recording material fed from the sheet feeding tray passes between the ink jet recording head and the platen and is nipped by the second roller portion, recording is carried out when the recording material is fed in an opposite direction between the ink jet recording head and the platen.

9 Claims, 5 Drawing Sheets

IMAGE FORMING APPARATUS

FIELD OF THE INVENTION AND RELATED ART

The present invention relates to an image forming apparatus, in particular, an image forming apparatus structured so that the feeding of unrecorded recording medium into the image forming apparatus, and the removal of recorded recording medium from the image forming apparatus can be carried out by a user from virtually the same position. It also relates to an image forming method usable by such an image forming apparatus.

An ink jet recording apparatus is advantageous in that it is low in noise, low in operational cost, easier to reduce in size, easier to colorize, etc. Therefore, it is widely used as the image forming apparatus for a printer, a copying machine, or the like.

In recent years, a digital camera has come to be widely used, and therefore, the consumer demand has increased for such a means that enables a user to easily print a photographic image at home. As the answer to this demand, various photo printers have been devised, which are capable of printing a photographic image without involving a computer, that is, directly from a memory card or a digital camera itself. Most of these photo printers are capable of yielding only a photographic image of a small size, more specifically, A6 size or the like sizes, equivalent to the size of an ordinary photograph or postcard. It seems to be reasonable to think that these photo printers are used by a wide range of users in various manners, and therefore, that they will be placed in various locations and in various manners. Thus, for the sake of ease of use, they are desired to be structured so that virtually the entirety of their functions can be controlled from the front side. In particular, they are desired to be structured so that not only can unrecorded recording mediums be fed into the printer from the front side, but also, recorded recording mediums can be removed from the front side of the printer. Presently, the most prevalent type of a small photo printer is the thermal sublimation type. As for the structural arrangement for making it possible not only for unrecorded recording mediums to be fed into the printer from the front side of the printer, but also, for recorded recording mediums to be removed from the printer from the front side thereof, it is the structural arrangement of the switch-back recording medium conveyance system. According to the switch-back recording medium conveyance system, a recording medium is fed into a recording apparatus from the front side of the apparatus, and is gripped by a pair of conveyance rollers located on the front side of the image recording portion. An image is completed on the recording medium while the recording medium remaining gripped by the pair of conveyance rollers is moved several times through the image recording portion. Then, the recording medium is discharged frontward of the apparatus by the conveyance rollers after the completion of the recording.

In the case of a small photo printer of the thermal sublimation type or the like, recording is made while conveying recording medium by gripping the recording medium with a pair of conveyance rollers disposed on the front side of the image recording portion. In this method, it is impossible to completely free the recording medium from the grip of the pair of conveyance rollers. In other words, one end of the recording medium, in terms of the recording medium conveyance direction, always remains gripped by the pair of conveyance rollers, making it impossible to record across the gripped portion of the recording medium. As a result, a copy having a white blank area across one of the edges is yielded. In other words, this method cannot form an image across the entire surface of a recording medium of a predetermined size; it cannot form a borderless image. Obviously, it is not possible to simply obtain a borderless copy using this method. Thus, in order to obtain a borderless copy of a predetermined size with the use of this method, it is necessary to use a recording medium dedicated for yielding a borderless copy, that is, a recording medium made up of a recording medium of a desired size and a tab extended from the edge of the recording medium, so that recording can be made while holding the dedicated recording medium by gripping this tab portion. After the formation of an image, the tab portion is cut off to obtain the borderless copy of the predetermined size. In other words, in order to obtain a borderless image of a predetermined size, this method requires a recording medium dedicated for the formation of a borderless copy, being therefore inconvenient. Moreover, a recording medium with an easily removable tab is high in manufacturing cost. Therefore, this method is greater in terms of the burden of the cost to a user.

Meanwhile, various ink jet recording apparatuses have been devised as image forming apparatuses capable of yielding a borderless photographic image. Many of these ink jet recording apparatuses have two pairs of conveyance rollers disposed on the front and rear sides of the image recording portions, one for one, so that recording can be made across both edge portions of a recording medium, in terms of the recording medium conveyance direction, by recording across one of the edge portions of the recording medium by holding the recording medium by the other edge portion, and then, recording across the second edge portion by holding the recording medium by the first edge portion.

In any of the ink jet recording apparatuses of the above described type, generally, as a recording medium is fed into the recording apparatus from the front side, it is first guided to the rear side of the apparatus through a first recording medium conveyance path located away from the image recording portion, is made to U-turn, and then, is conveyed through a second recording medium conveyance path to the image recording portion, in which recording is made on the recording medium. After the recording, the recording medium is discharged frontward of the recording apparatus. In other words, the recording apparatus is provided with the first recording medium conveyance path (which hereafter may be referred to simply as first conveyance path) which extends from the front side of the recording apparatus to the rear side, and the second recording medium conveyance path (which hereinafter may be referred to simply as second conveyance path) which extends from the rear side of the recording apparatus to the front side. Further, the recording apparatus is provided with a U- or V-shaped connective path to guide a recording medium between the first and second conveyance paths. In other words, the recording apparatus needs to be provided with two recording medium conveyance paths independent from each other, resulting in an increase in the number of recording medium conveying means such as the conveyance roller pairs, in particular, in the measurement of the recording apparatus in terms of the direction perpendicular to the direction in which the recording medium conveyance paths are disposed in parallel, as well as apparatus cost. One of the methods for reducing a recording apparatus in size is to reduce in size the connective path between the aforementioned two conveyance paths, and in order to reduce in size the connective path, it cannot be avoided to structure a recording apparatus so that the connective path is sharply curved, that is, bent with a very sharp curvature; in other words, it cannot be avoided to structure a recording apparatus so that as a recording medium is conveyed through the connective path, it is made to sharply curve. Thus, if a recording apparatus structured as described above is used to record on a photographic paper, which is relatively thick, it is rather difficult to smoothly move the photographic paper from one conveyance path to the other while causing the paper to sharply curve. Further, this recording apparatus is problematic in that if it is used for recording on a sheet of self-adhesive blank labels made up of self-adhesive blank labels and a substrate paper, the self-adhesive blank labels become separated from the substrate paper as the sheet is curved while it is moved through the connective path. In other words, this recording method is not suitable for recording on unusual recording medium, such as the abovementioned special purpose recording mediums.

Japanese Laid-open Patent Application 2003-40505 discloses a method for setting, according to the rigidity of recording medium, the speed at which recording medium is discharged from an ink jet recording apparatus structured so that both the operation of feeding unrecorded recording medium into the recording apparatus, and the operation of removing recorded recording medium therefrom, can be performed from the front side of the apparatus. This method is effective to stabilize the ink jet recording apparatus in terms of the recording medium discharging operation, regardless of recording medium rigidity. However, it does not deal with the problem that recording medium is made to abruptly and sharply curve. In other words, this patent application does not disclose any innovative idea for smoothly conveying the abovementioned relatively thick photographic paper, sheet of self-adhesive blank labels, etc., prior to the starting of the paper discharging step.

SUMMARY OF THE INVENTION

The present invention can provide an image forming apparatus of the ink jet type, which is structured so that the operation of feeding an unrecorded recording medium into the image forming apparatus, and the operation of removing a recorded recording medium therefrom, can be performed from the same side of the apparatus; is smaller in size and cost; is suitable to be used with various special purpose recording media; and is suitable for recording in the borderless fashion, and also, can provide an image forming method to be used with such an image forming apparatus.

According to an aspect of the present invention, there is provided an image forming apparatus for forming an image on a recording material by an image recording portion, said image forming apparatus comprising a sheet feed/discharge portion, disposed at one side of a main assembly of the apparatus, for feeding a recording material to be recorded and for discharging a recorded recording material; a second roller portion rotatable in forward and backward directions and disposed at a sheet feed/discharge portion side with respect to said image recording portion; and a first roller portion rotatable in forward and backward directions and disposed at a side opposite the sheet feed/discharge portion with respect to said image recording portion; wherein when the recording material to be recorded is supplied from said sheet feed/discharge portion side, the recording material is fed toward said opposite side through a feeding path extending along said image recording portion, and the recording material is fed back toward said sheet feed/discharge portion side through said feeding path while forming the image by said image recording portion on the recording material.

According to another aspect of the present invention, there is provided an image forming method for forming an image on a recording material by an image recording portion, said method comprising a step of preparing a sheet feed/discharge portion at one side of a main assembly of a recording apparatus; a step of feeding a recording material to be recorded from the sheet feed/discharge portion; a step of preparing a second roller portion rotatable in forward and backward directions and disposed at a sheet feed/discharge portion side with respect to said image recording portion, and a first roller portion rotatable in forward and backward directions and disposed at a side opposite the sheet feed/discharge portion with respect to said image recording portion; a step of feeding the recording material toward said opposite side through a feeding path extending along said image recording portion by said second and first roller portions; a step of feeding the recording material back toward said sheet feed/discharge portion side through said feeding path while forming the image by said image recording portion on the recording material.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

Hereinafter, the preferred embodiments of the present invention will be described with reference to the appended drawings.

Figure 1:
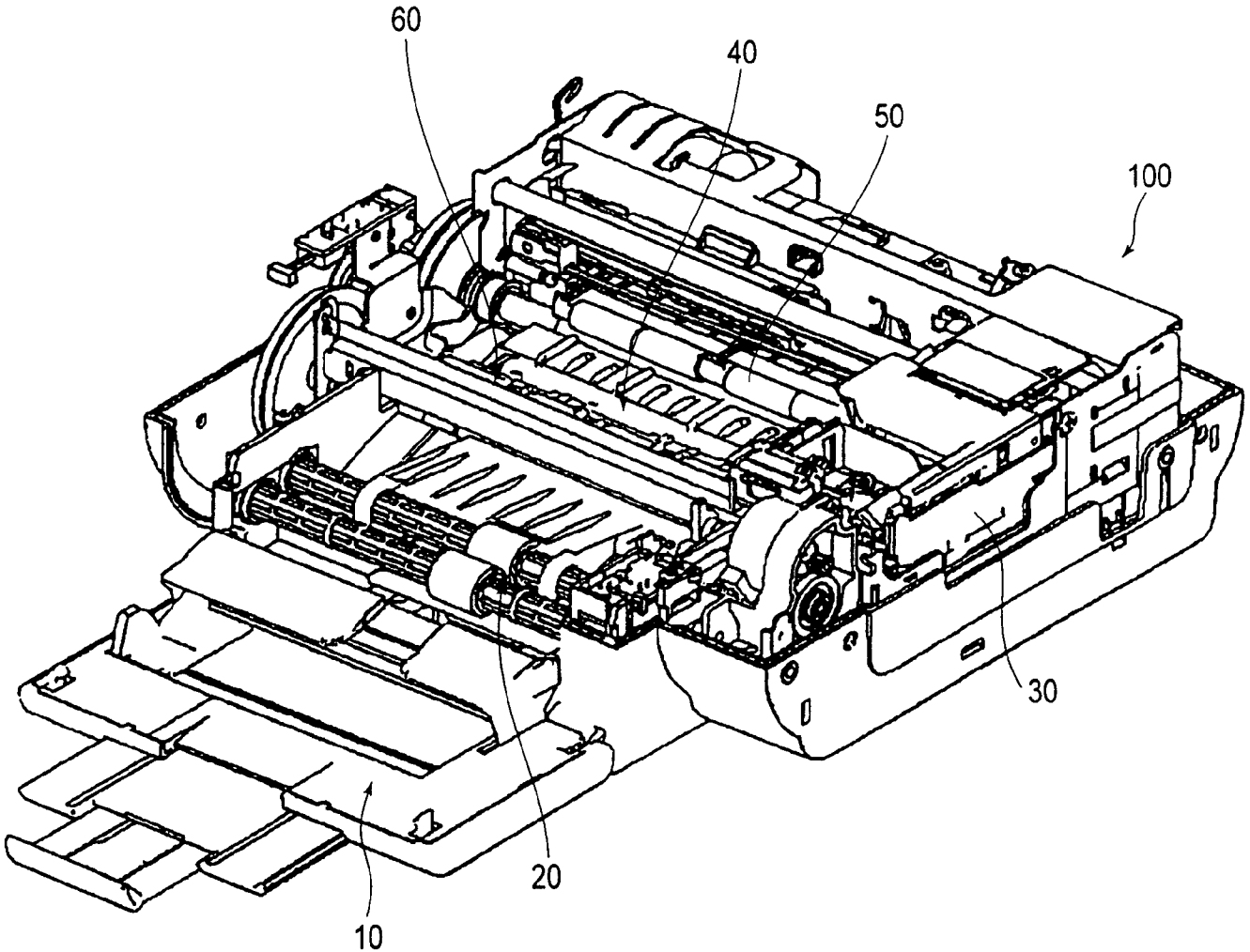
FIG. 1 is a perspective view of the ink jet printer in the first embodiment of the present invention, depicting the general structure thereof.

FIG. 1 is a perspective view of the ink jet printer in the first embodiment of the present invention, showing the general structure thereof. As shown in FIG. 1, the ink jet printer 100 comprises: a paper feeding/discharging portion 10 through which a plurality (inclusive of single) of unrecorded recording mediums (sheet of recording paper or the like) are fed into the recording apparatus, and also, through which a plurality of recorded recording mediums are discharged from the ink jet printer 100; a sheet separating-conveying portion 20 which separates the recording mediums one by one and conveys them to an image recording portion; an image recording portion 40 which constitutes a part of the recording medium conveyance path, and comprises a recording means such as an ink jet recording head 30 for forming an image on the recording medium; a second recording medium conveying portion 60 disposed on the front side of the image recording portion 40; and a first recording medium conveying portion 50 disposed on the rear side of the image recording portion 40. The side on which the paper feeding/discharging portion 10 is disposed is the front side of the ink jet printer 100 (side from which user operates printer). In this embodiment, it is from the front side of the ink jet printer that unrecorded mediums are set in the ink jet printer and recorded mediums are discharged from the ink jet printer. Throughout the following description of the embodiments of the present invention, the front side of the ink jet printer 100 will be referred to as front, and the opposite side of the ink jet printer 100 from the front (side greater in distance from paper feeding/discharging portion 10 of ink jet printer 100 than front) will be referred to as rear. As will be evident from FIGS. 1-4, the ink jet printer 100 in this embodiment has the paper feeding/discharging portion 10, paper separating/conveying portion 20, second recording medium conveying portion 60, image recording portion 40, and first recording medium conveying portion 50, which are disposed in this order from the front.

Figure 2:
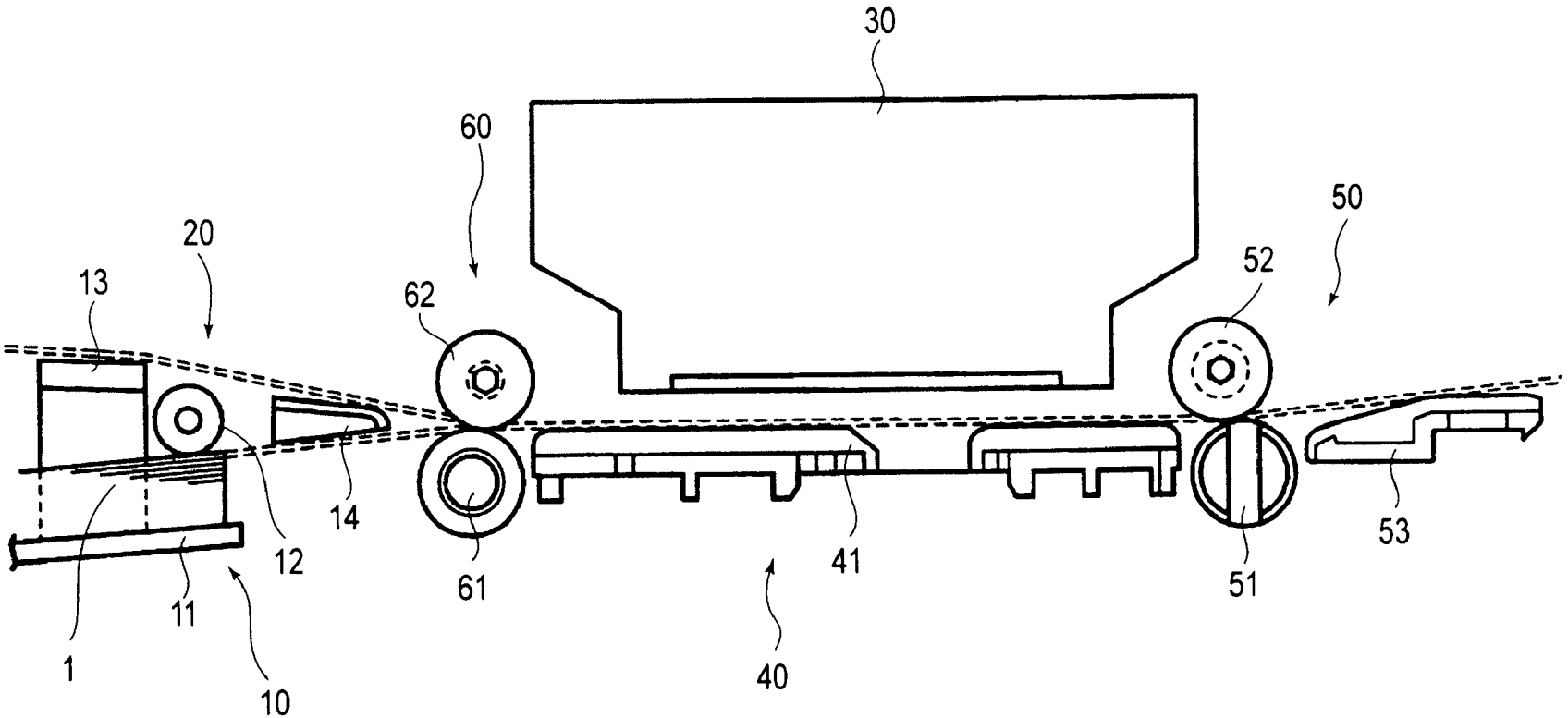
FIG. 2 is a side view of the essential portion of the ink jet printer shown in FIG. 1, depicting the internal structure thereof.

Next, referring to FIGS. 2-4, the structure of each of the various portions of this ink jet printer 100 will be described.

As described above, the paper feeding/discharging portion 10 is located in the front portion (left side in FIG. 2) of the ink jet printer 100. The paper feeding/discharging portion 10 has a paper feeder tray 11 (paper feeding portion) in which a plurality of unrecorded mediums (sheets of recording paper 1 or the like) are storable in layers, and a paper delivery tray 13 (into which recording paper is discharged) in which recording papers 1 are stacked as they are discharged from the ink jet printer 100 after recording. The delivery tray 13 is disposed above the feeder tray 11, virtually completely overlapping with the feeder tray 11 in terms of the vertical direction. Although not shown in the drawings, the feeder tray 11 is provided with a pressure applying member for keeping the recording papers 1 in the feeder tray 11 pressured toward a paper feeding roller 12 (which hereinafter will be referred to as feed roller 12), which will be described later.

The paper separating/conveying portion 20 comprises the feed roller 12, which conveys the recording medium(s) 1 in the feeder tray 11 by coming in contact with each of the recording mediums 1. The paper separating/conveying portion 20 also has an unshown paper separating member, which is rendered independent from, or slaved to, the feed roller 12. This separating member is for picking up only the topmost recording paper 1 from the plurality of recording papers 1 stored in layers in the feeder tray 11. As for the means for separating the recording papers 1 in coordination with the paper separating member, any of the known paper separation mechanisms may be employed. For example, the separating/conveying portion 20 may be provided with a roller with an internal torque limiter, which is disposed in a manner to press on the feed roller 12 so that as the recording paper 1 is fed into the ink jet printer 100, it will press on the back (bottom) surface of a recording paper 1.

The image recording portion 40 has the ink jet recording head 30, and a platen 41 (third guiding member) which supports the recording paper 1 in such a manner that the recording paper 1 squarely faces the ink jet recording head 30. Although it will not be illustrated, the ink jet recording head 30 may be mounted on a carriage movable in the direction parallel to the width direction of the recording paper 1. In such a case, the conveyance of the recording paper 1 by the first and second recording medium conveying portions 50 and 60, which will be described later, and the movement of the carriage in the direction intersectional to the direction in which the recording paper 1 is moved by the first and second recording medium conveying portions 50 and 60, are alternated, and the ink jet recording head 30 ejects ink toward the recording paper 1 with an optimal timing while the carriage is moved. As a result, an image is recorded on the recording paper 1. Incidentally, in this specifications of the present invention, "recording" and "image recording" mean not only the formation of such images as characters, symbols, or drawings, which have a meaning, but also, such images as random patterns, or designs, which do not have a specific meaning.

In front of the image recording portion 40, that is, in front of the platen 41, the second conveyance roller 61 and a follower roller 62, which together constitute the second recording medium conveying portion 60, are disposed. Behind the image recording portion 40, that is, behind the platen 41, the first conveyance roller 51 and a pinch roller 52, which together constitute the first recording medium conveying portion 50 are disposed. Further, behind the first recording medium conveying portion 50, a paper guide 53 (second guiding member) which temporarily supports the recording paper 1 while the recording paper is fed is disposed. Both the roller 62 and pinch roller 52 may be a follower roller.

Between the separating/conveying portion 20 and second recording medium conveying portion 60, a paper guide 14 (first guiding member) is disposed, which prevents the unrecorded paper, which is to be fed into the ink jet printer 100 from the feeder tray 11, from interfering with the recorded paper 1 which is being discharged into the delivery tray 13.

Next, the process of recording an image on the recording paper 1 with the use of the ink jet printer 100 structured as described above will be described.

Figure 3:
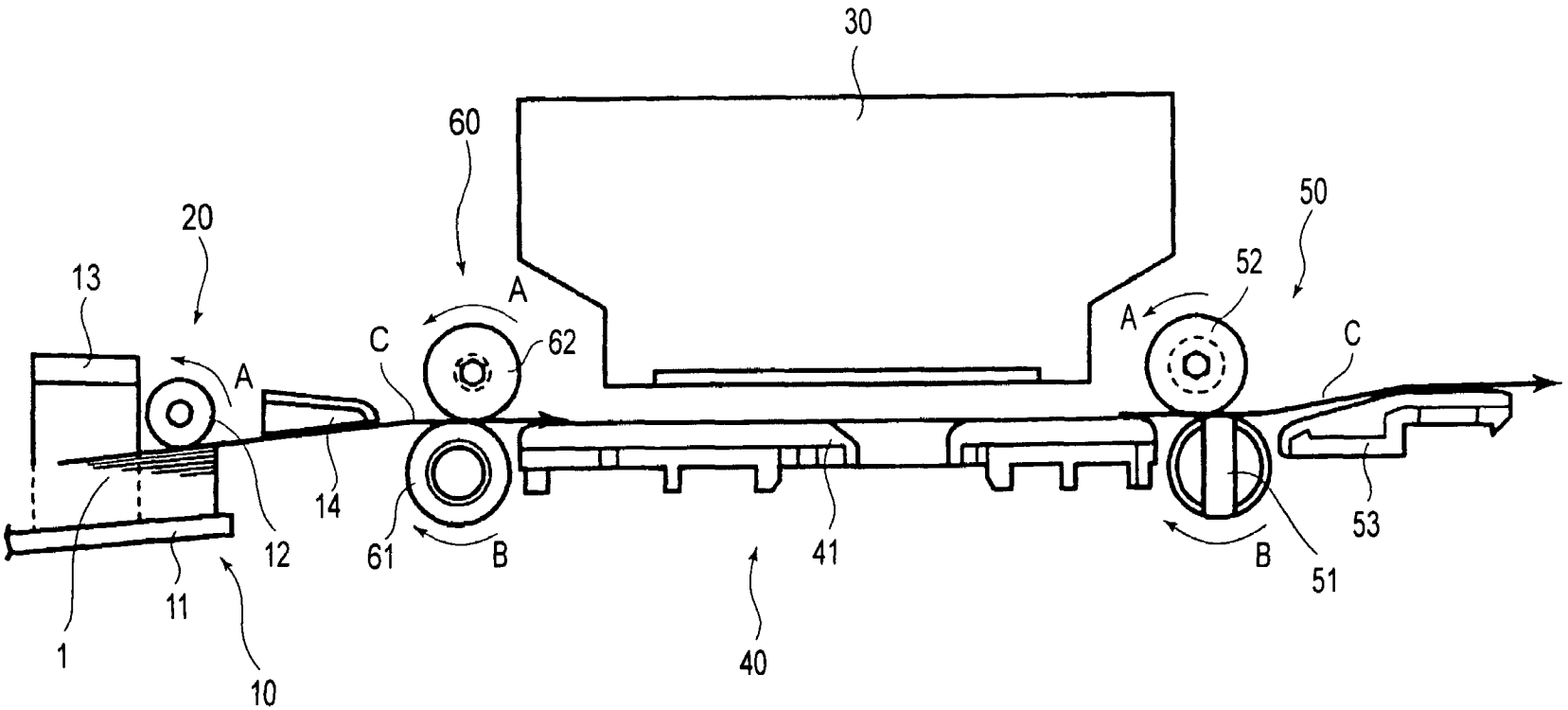
FIG. 3 is also a side view of the essential portion of the ink jet printer shown in FIG. 1, depicting how recording medium is fed into the ink jet printer (through inward path).

Referring to FIG. 3, the recording papers 1 stored in layers in the feeder tray 11 are drawn out of the feeder tray 11 by the feed roller 12, which is being rotated in the direction indicated by an arrow mark A, while being separated one by one by the coordination between the feed roller 12 and the unshown paper separating member. Then, each recording paper 1 is conveyed in the direction indicated by an arrow mark C. When the recording paper 1 is conveyed in the arrow mark C direction, it is moved below the paper guide 14, and reaches the second recording medium conveying portion 60. During this conveyance of the recording paper 1, the second conveyance roller 61 of the second recording medium conveying portion 60 is being rotated in the direction indicated by an arrow mark B so that the recording paper 1 is pulled rearward, that is, pulled into the image recording portion 40, whereas the roller 62 is rotating in the arrow mark A direction.

After being sent into the image recording portion 40 by the second recording medium conveying portion 60, the recording paper 1 is conveyed, while being guided by the top surface of the platen 41, to the first recording medium conveying portion 50 disposed behind the image recording portion 40. During this conveyance of the recording paper 1, the first conveyance roller 51 and pinch roller 52 are being rotated in the directions indicated by arrow marks B and A, respectively, so that the recording paper 1 is sent further into the ink jet printer 100. Thus, the recording paper 1 is conveyed further in the direction indicated by an arrow mark C, that is, further into the ink jet printer 100, to the position in which the trailing edge of the recording paper will have moved completely past the image recording portion 40, but, it will still remain gripped between the first conveyance roller 51 and pinch roller 52. Then, the recording paper 1 is held in this position, being supported by the paper guide 53. As for the means for stopping the conveyance of the recording paper 1 inward of the ink jet printer 100, the ink jet printer 100 may be structured so that the inward conveyance of the recording paper 1 is stopped the moment it is detected by an unshown sensor or the like that the trailing edge of the recording paper 1 has moved past the recording start point of the image recording portion 40. As will be evident from the above description of the recording operation of the ink jet printer 100, until the completion of the inward conveyance of the recording paper 1 to the above described position, the image recording portion 40 is kept inactive, and therefore, no recording is made on the recording paper 1.

Figure 4:
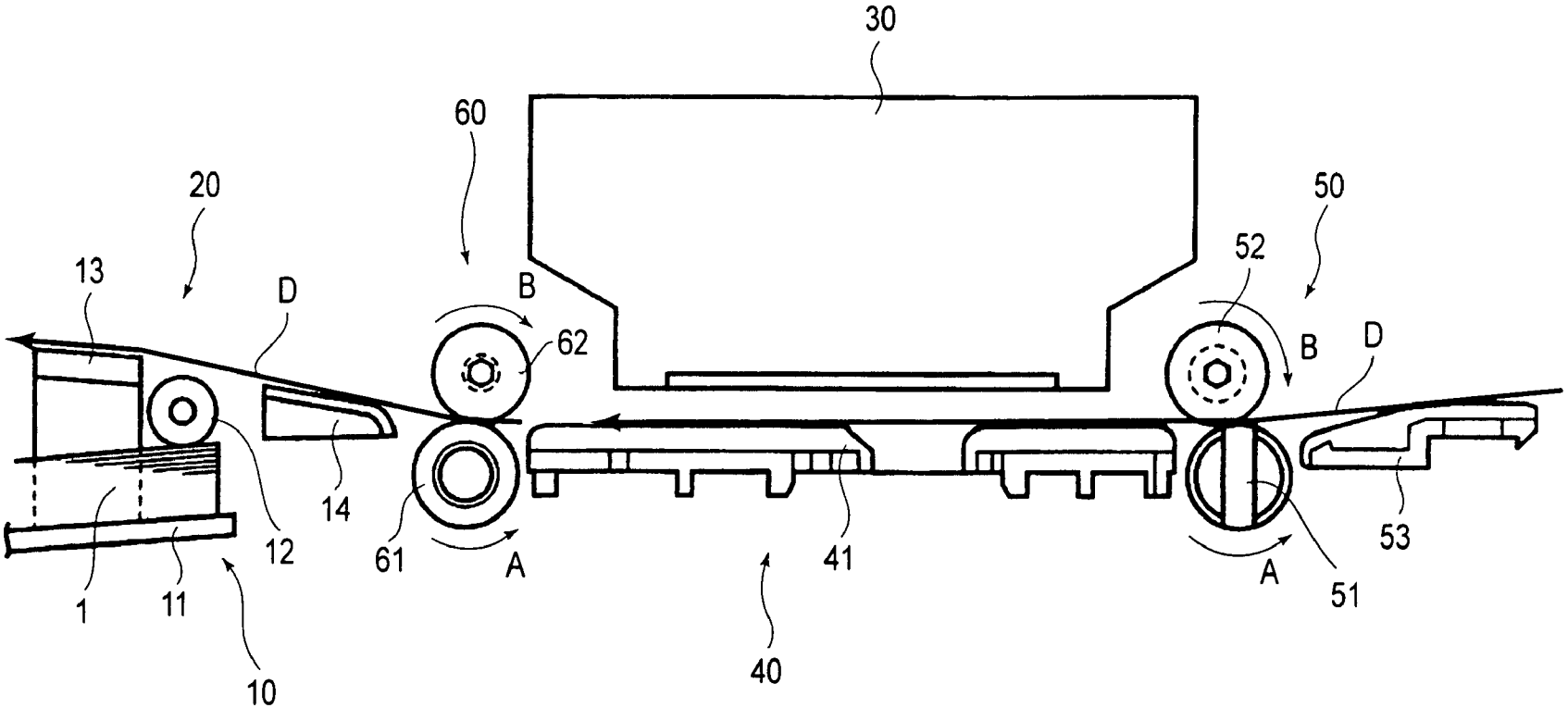
FIG. 4 is a side view of the essential portion of the ink jet printer shown in FIG. 1, depicting how recording medium is discharged from the ink jet printer (through outward path).

Next, referring to FIG. 4, the first conveyance roller 51 and pinch roller 52 are rotated in the direction opposite to the direction in which they are rotated to feed the recording paper 1 into the ink jet printer 100 (first conveyance roller 51 is rotated in arrow mark A direction, whereas pinch roller 52 is rotated in arrow mark B direction). Therefore, the recording paper 1, having been conveyed rearward completely past the image recording portion 40 and resting on the top surface of the paper guide 53, is moved backward, that is, the direction is indicated by an arrow mark D, being thereby sent back into the image recording portion 40. During this outward conveyance of the recording paper 1, the second conveyance roller 61 and roller 62 are also rotated in the direction opposite to the direction in which they are rotated during the feeding of the recording paper 1 into the ink jet printer 100 (second conveyance roller 61 is rotated in arrow mark A direction, whereas roller 62 is rotated in arrow mark B direction). Then, as the leading edge of the recording paper 1 reaches the second conveyance roller 61 and roller 62, the recording paper 1 is further conveyed in the arrow mark D direction by the rotation of the rollers 61 and 62 of the second recording medium conveying portion 60 as well as the rotation of the rollers 51 and 52 of the first recording medium conveying portion 50.

As the recording paper 1 is conveyed into the image recording portion 40 in the arrow mark D direction, the recording paper conveyance by the rotation of the rollers of the first and second recording medium conveying portions 50 and 60, and the movement of the unshown carriage, during which ink is ejected from the ink jet recording head 30, are alternated as described before. As a result, an image is formed on the surface of the recording paper 1 by the ink droplets. In this embodiment, the ink jet printer 100 is structured so that the recording paper 1 is gripped by both, or at least one, of the roller pairs of the first and second recording medium conveying portions 50 and 60, which are located in front of and behind the image recording portion 40, respectively, and also, so that recording can be made on the recording paper 1 even when the recording paper 1 is gripped by only one of the first and second recording medium conveying portions 50 and 60. Therefore, the ink jet printer 100 is capable of forming a so-called borderless image even on an ordinary paper. More specifically, the ink jet recording head 30 begins to form an image on the surface, inclusive of the edge portion, of the recording paper 1 which is moved frontward from the rear side of the ink jet printer 100, resting on the platen 41, while its trailing edge, or its adjacencies, remains gripped by the roller pair of the first recording medium conveying portion 50, and its leading edge has not reached the roller pair of the second recording medium conveying portion 60 (being therefore not gripped by roller pair of second recording medium conveying portion 60). Then, the ink jet recording head 30 records across the mid portion of the recording paper 1 while the trailing edge, or its adjacencies, of the recording paper 1 is gripped by the roller pair of the first recording medium conveying portion 50 and the leading edge, or its adjacencies, of the recording paper 1 is gripped by the roller pair of the second recording medium conveying portion 60. As the recording by the ink jet recording head 30 continues, the recording paper 1 is conveyed further frontward, causing the trailing edge of the recording paper 1 to be freed from the grip of the roller pair of the first recording medium conveying portion 50, with the leading edge portion of the recording paper 1 remaining gripped by the roller pair of the second recording medium conveying portion 60. When the recording paper 1 is in this condition, the ink jet recording head 30 records on the trailing portion, inclusive of the trailing edge, of the recording paper 1 which is resting on the platen 41. In other words, in this embodiment, while the recording paper 1 is gripped by only one of the recording medium conveying portions 50 and 60, recording is made across the opposite portion (inclusive of edge) of the recording paper 1 from the portion by which the recording paper is gripped by one of the recording medium conveying portions 50 and 60. Therefore, recording can be made across the entire surface, inclusive of edges, of the recording paper 1.

During the actual image forming operation, the recording paper 1 is intermittently conveyed in the arrow mark D through the image recording portion 40. As a result, the recording paper 1 slides onto the paper guide 14. Further, even after the trailing edge of the recording paper 1 moves past the first recording medium conveying portion 50, the conveyance of the recording paper 1 by the second recording medium conveying portion 60 continues. Then, the recording paper 1 is discharged into the delivery tray 13 after the completion of the recording on the recording paper 1.

As described above, in the case of the ink jet printer 100, in this embodiment, the feeder tray 11 and delivery tray 13 of which are both on the front side, the path (inward path) through which the recording paper 1 is conveyed to be fed from the feeder tray 11 into the printer, and the path (outward path) through which the recording paper is conveyed to be discharged from the printer into the delivery tray 13, are the same. In other words, this embodiment makes it unnecessary to provide a printer with two recording paper conveyance paths, eliminating thereby the need for a complicated mechanical structure (for example, connective path) for switching a recording paper conveyance path, and the structural components therefore. Moreover, in the case of the ink jet printer in this embodiment, the essential portions of the recording paper conveyance path, inclusive of the portion in the image recording portion 40, are virtually horizontal. In other words, this embodiment contributes to the reduction of the overall height of a printer, and also, to the cost reduction of a printer. Further, the ink jet printer 100 in this embodiment does not bend the recording paper 1 at all in practical terms. Therefore, it is suitable for recording on special purpose recording media, such as a relatively thick photographic paper or a sheet of self-adhesive blank labels made up of self-adhesive blank labels and a substrate paper from which self-adhesive labels easily peel.

Also in the case of the ink jet printer in this embodiment, the paper guide 53 and paper guide 14 are positioned slightly higher than the platen 41 of the image recording portion 40. Therefore, such force that acts to keep the recording paper 1 pressed on the platen 41 is generated. Thus, this embodiment is suitable for a recording apparatus employing a noncontact recording system such as the ink jet recording system. Nevertheless, the paper guides 53 and 14 may be positioned at the same level as the platen 41 to render horizontal the entirety of the recording paper conveyance path so that not only is the recording apparatus reduced in height, but also, the recording paper 1 is not bent even slightly.

Figure 5:
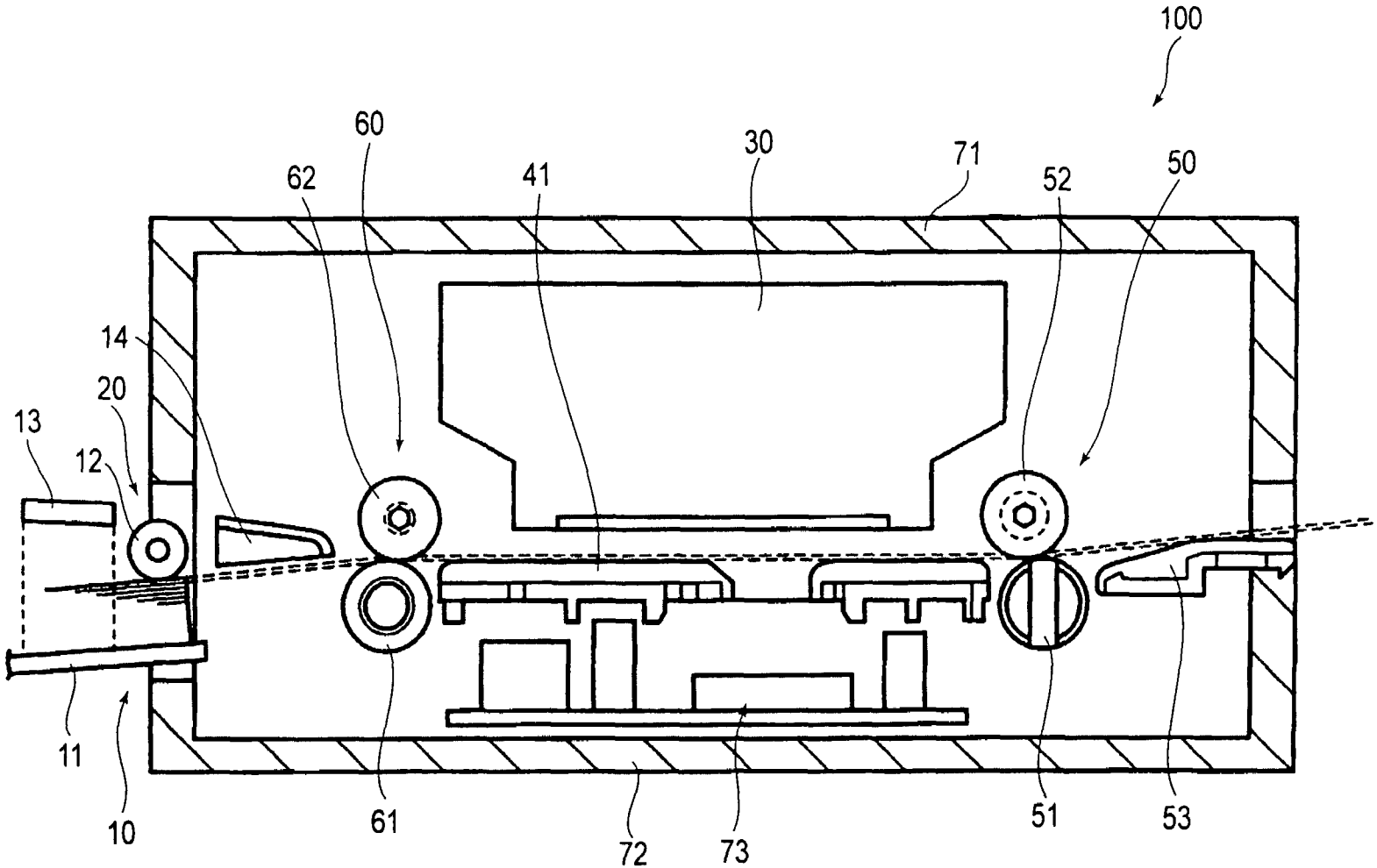
FIG. 5 is a side view of the ink jet printer in another embodiment of the present invention.

Referring to FIG. 5, it is possible to dispose a controller portion 73 such as a logic circuit under the platen 41, which constitutes a part of the recording paper path, in the portions 71 and 72 of the housing of the ink jet printer 100, in order to further reduce in size the ink jet printer 100. The controller portion 73 is for electrically controlling the operations of various members of the ink jet printer 100, for example, the movements of the rollers 12, 51, 52, 61, and 62, the operation of the ink jet recording head 30, etc.

According to the present invention related to image forming apparatus structure and image forming method, the feeding of unrecorded medium into an image forming apparatus, and the removal of recorded medium from the image forming apparatus can be carried from the same side, for example, the front side, of the main assembly of the image forming apparatus. Therefore, not only can the present invention improve an image forming apparatus in terms of operability, but also, reduce an image forming apparatus in size and cost. Further, the present invention makes it possible to provide an image forming apparatus which is capable of recording in the borderless fashion, and also, suitable for recording on a special purpose recording medium. In other words, the present invention makes it possible to provide an image forming apparatus capable of meeting multifarious demands which have been made in recent years.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 145072/2004 filed May 14, 2004, which is hereby incorporated by reference.

What is claimed is:

1. An ink jet recording apparatus comprising:

a sheet feeding tray for stacking a plurality of recording materials before recording;

a sheet discharge tray, provided at a position overlapping said sheet feeding tray, for stacking the recording materials discharged after completion of the recording;

a sheet feeding roller for contacting and feeding the recording materials stacked on said sheet feeding tray;

an image recording portion including an ink jet recording head and a platen for supporting the recording material so as to face said ink jet recording head;

a first roller portion for feeding the recording material; and a second roller portion, disposed at a position between said sheet feeding tray and said image recording portion and across said image recording portion from said first roller portion, for feeding the recording material; and a guide, positioned between said sheet feeding roller and said second roller portion, for separating the recording material fed from said sheet feeding tray and the recording material to be fed to said sheet discharge tray from each other, wherein after the recording material fed from said sheet feeding tray passes between said ink jet recording head and said platen and is nipped by said first roller portion, the recording is carried out when the recording material is fed in an opposite direction between said ink jet recording head and said platen.

2. An image forming method for forming an image on a recording material by an image recording portion, said method comprising:

a step of preparing a sheet feeding tray for stacking a plurality of recording materials before recording, a sheet discharge tray, provided at a position overlapping the sheet feeding tray, for stacking the recording materials discharged after completion of the recording, a sheet feeding roller for contacting and feeding the recording materials stacked on the sheet feeding tray, an image recording portion including an ink jet recording head and a platen for supporting the recording material so as to face the ink jet recording head, a first roller portion for feeding the recording material, a second roller portion, disposed at a position between the sheet feeding tray and the image recording portion and across the image recording portion from the first roller portion, for feeding the recording material, and a guide, positioned between the sheet feeding roller and the second roller portion, for separating the recording material fed from the sheet feeding tray and the recording material to be fed to the sheet discharge tray from each other;

a step of feeding a recording material to be recorded from the sheet feeding tray; and a step of, after the recording material fed from the sheet feeding tray passes between the ink jet recording head and the platen and is nipped by the first roller portion, carrying out recording when feeding the recording material in an opposite direction between the ink jet recording head and the platen.

3. A method according to claim 2, wherein when only a part of the recording material is nipped by only one of the first roller portion and the second roller portion during feeding of the recording material in the opposite direction, the image recording portion records the image at an end portion relatively closer to the other of the first roller portion and the second roller portion, so as to form the image on a whole surface of the recording material.

4. A method according to claim 2, wherein the ink jet recording head forms the image by ejecting ink onto the recording material.

5. An apparatus according to claim 1, wherein said ink jet recording head is carried on a carriage which is movable in a widthwise direction of the recording material.

6. An apparatus according to claim 1, wherein said image recording portion effects recording on the whole surface of the recording material by effecting, when only one of said first roller portion and said second roller portion holds the recording material, recording on an end portion closer to the other of said first roller portion and said second roller portion.

7. An apparatus according to claim 1, further comprising an additional guide disposed at a position across said first roller portion from said image recording portion to guide the recording material.

8. An apparatus according to claim 1, wherein a side where said sheet feeding tray and said sheet discharge tray are provided is a front side of said apparatus.

9. An apparatus according to claim 1, further comprising a control portion below said image recording portion.

* * * * *